US006814304B2

(12) United States Patent
Onofrio

(10) Patent No.: US 6,814,304 B2
(45) Date of Patent: Nov. 9, 2004

(54) ROTATING STREAM SPRINKLER WITH SPEED CONTROL BRAKE

(75) Inventor: Travis L. Onofrio, Whittier, CA (US)

(73) Assignee: Rain Bird Corporation, Azusa, CA (US)

( * ) Notice: Subject to any disclaimer, the term of this patent is extended or adjusted under 35 U.S.C. 154(b) by 0 days.

(21) Appl. No.: 10/310,584

(22) Filed: Dec. 4, 2002

(65) Prior Publication Data

US 2004/0108391 A1 Jun. 10, 2004

(51) Int. Cl.[7] ..... B05B 15/06
(52) U.S. Cl. ..... 239/201; 239/203; 239/204
(58) Field of Search ..... 239/200, 201, 239/203, 204, 205, 206, 256, 498, 501

(56) References Cited

U.S. PATENT DOCUMENTS

| | | | | |
|---|---|---|---|---|
| 2,108,787 A | | 2/1938 | Coles et al. | |
| 3,580,507 A | * | 5/1971 | Beamer | 239/233 |
| 3,592,388 A | * | 7/1971 | Friedlander | 239/233 |
| 3,888,417 A | * | 6/1975 | Harmon | 239/97 |
| 4,265,403 A | * | 5/1981 | Bonetti | 239/66 |
| 4,440,345 A | | 4/1984 | Figwer et al. | |
| 4,637,549 A | | 1/1987 | Schwartzman | |
| 4,660,766 A | | 4/1987 | Nelson et al. | |
| 4,687,139 A | | 8/1987 | Lockwood | |
| 4,796,811 A | | 1/1989 | Davisson | |
| 4,815,662 A | | 3/1989 | Hunter | |
| 4,886,211 A | | 12/1989 | Cohen | |
| 4,898,332 A | | 2/1990 | Hunter et al. | |
| 4,932,590 A | | 6/1990 | Hunter | |
| 4,971,250 A | | 11/1990 | Hunter | |
| 4,986,474 A | | 1/1991 | Schisler et al. | |
| 5,007,586 A | | 4/1991 | Cohen | |
| 5,014,372 A | | 5/1991 | Thrasher et al. | |
| 5,058,806 A | | 10/1991 | Rupar | |
| RE33,823 E | | 2/1992 | Nelson et al. | |
| 5,224,653 A | | 7/1993 | Nelson et al. | |
| 5,288,022 A | | 2/1994 | Sesser | |
| 5,297,737 A | * | 3/1994 | Davisson | 239/222.17 |
| 5,353,989 A | * | 10/1994 | Drechsel | 239/230 |
| 5,372,307 A | | 12/1994 | Sesser | |
| 5,377,914 A | | 1/1995 | Christen | |
| 5,476,223 A | * | 12/1995 | Drechsel | 239/252 |
| 5,671,886 A | * | 9/1997 | Sesser | 239/222.21 |
| 5,730,365 A | | 3/1998 | Messinger | |
| 5,845,849 A | | 12/1998 | Mitzlaff | |
| 5,971,297 A | | 10/1999 | Sesser | |
| 6,135,364 A | | 10/2000 | Nickish | |
| 6,193,169 B1 | | 2/2001 | Steinhilber et al. | |
| 6,244,521 B1 | | 6/2001 | Sesser | |
| 6,499,672 B1 | * | 12/2002 | Sesser | 239/222.11 |

FOREIGN PATENT DOCUMENTS

JP 405329404 A * 12/1993

* cited by examiner

*Primary Examiner*—William Doerrler
*Assistant Examiner*—Mohammad M. Ali
(74) *Attorney, Agent, or Firm*—Fitch, Even, Tabin & Flannery

(57) ABSTRACT

A rotating stream sprinkler of the type having a rotatable deflector for sweeping small streams of irrigation water in a radially outward direction to irrigate adjacent vegetation, wherein the sprinkler includes a speed control brake for maintaining a substantially constant deflector rotational speed throughout a range of normal operating pressures and flow rates. The deflector includes an array of spiral vanes engaged by one or more water jets for rotatably driving the deflector which converts the jets into a plurality of relatively small irrigation streams swept over the surrounding terrain. A friction plate rotatable with the deflector engages a brake pad retained against a nonrotating brake disk. The brake pad includes tapered contact faces for varying the friction contact radius in response to changes in water pressure and/or flow rate to maintain deflector rotational speed substantially constant.

26 Claims, 4 Drawing Sheets

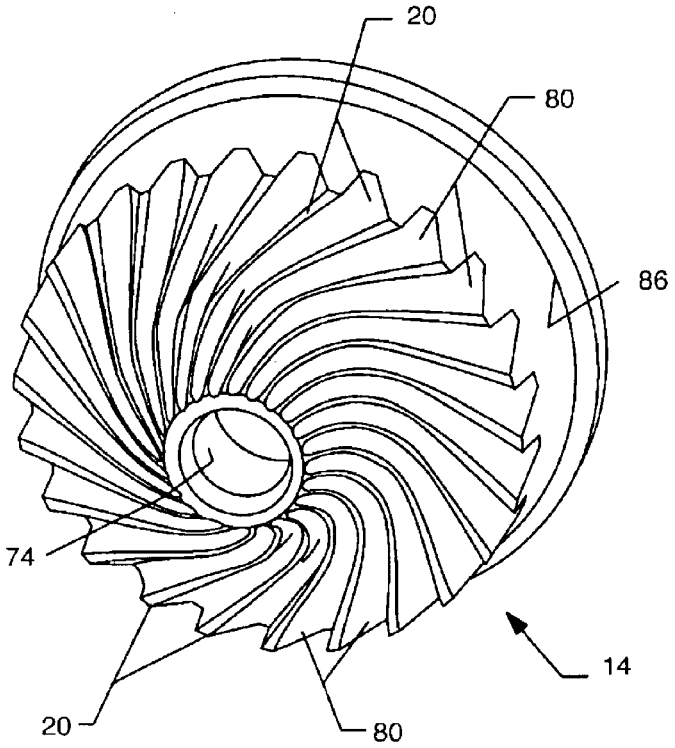
FIG. 5
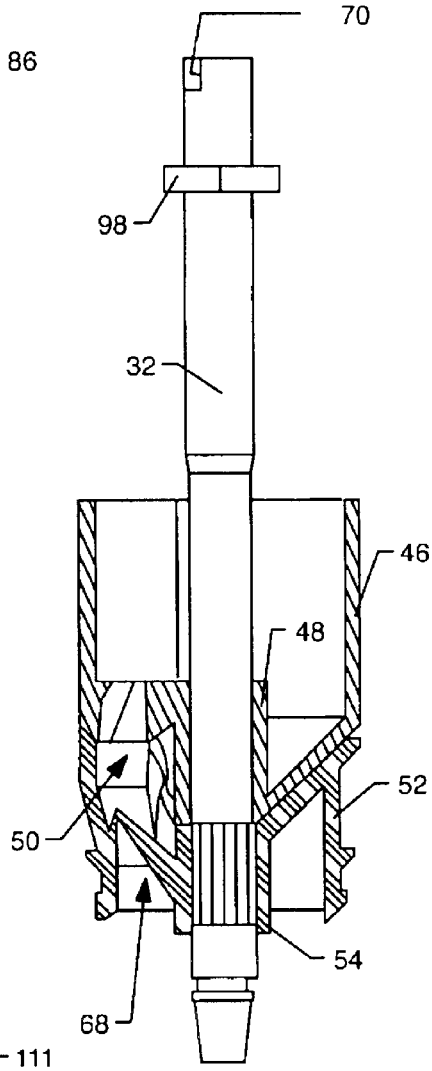
FIG. 7
FIG. 6
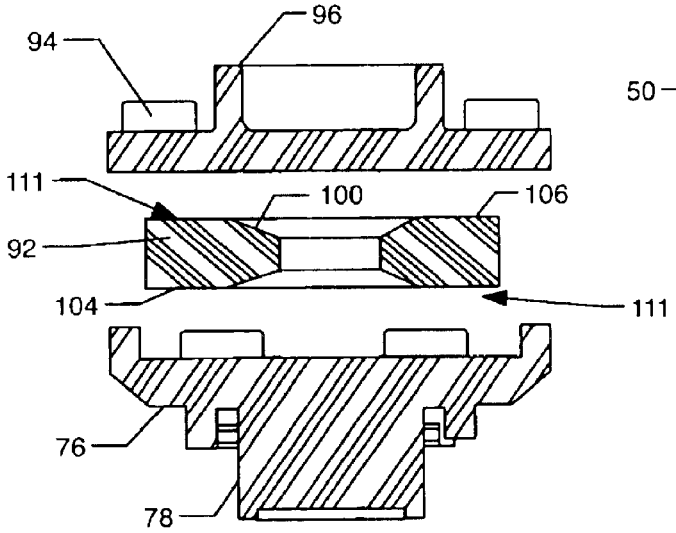

ROTATING STREAM SPRINKLER WITH SPEED CONTROL BRAKE

BACKGROUND OF THE INVENTION

This invention relates generally to improvements in irrigation sprinklers, particularly of the rotating or so-called micro-stream type having a rotatably driven vaned deflector for producing a plurality of relatively small water streams swept over a surrounding terrain area to irrigate adjacent vegetation. More specifically, this invention relates to a rotating stream sprinkler having an improved speed control brake for maintaining the rotational speed of the vaned deflector substantially constant throughout a range of normal operating pressures and flow rates.

Rotating stream sprinklers of the type having a rotatable vaned deflector for producing a plurality of relatively small outwardly projected water streams are well known in the art. In such sprinklers, sometimes referred to as micro-stream sprinklers, one or more jets of water are directed upwardly against the rotatable deflector which has a vaned lower surface defining an array of relatively small flow channels extending upwardly and turning radially outwardly with a spiral component of direction. The water jet or jets impinge upon this underside surface of the deflector to fill these curved channels and to rotatably drive the deflector. At the same time, the water is guided by the curved channels for projection generally radially outwardly from the sprinkler in the form of a plurality of relatively small water streams to irrigate adjacent vegetation. As the deflector is rotatably driven, these water streams are swept over the surrounding terrain area, with a range of throw depending in part on the channel configuration. Such rotating stream sprinklers have been designed for irrigating a surrounding terrain area of predetermined pattern, such as a full circle, half-circle, or quarter-circle pattern. For examples of such rotating stream sprinklers, see U.S. Pat. Nos. 5,288,022; 5,058,806; and 6,244,521.

In rotating stream sprinklers of this general type, it is desirable to control or regulate the rotational speed of the vaned deflector and thereby also regulate the speed at which the water streams are swept over the surrounding terrain area. In this regard, in the absence of speed control or brake means, the vaned deflector can be rotatably driven at an excessive speed up to and exceeding 1,000 rpm, resulting in rapid sprinkler wear and distorted water stream delivery patterns. A relatively slow deflector rotational speed on the order of about 4–20 rpm is desired to achieve extended sprinkler service life while producing uniform and consistent water stream delivery patterns. Toward this end, a variety of fluid brake devices have been developed wherein a rotor element carried by the vaned deflector is rotatably driven within a closed chamber containing a viscous fluid. In such designs, the viscous fluid applies a substantial drag to rotor element rotation which significantly reduces the rotational speed of the vaned deflector during sprinkler operation.

While such fluid brake devices are effective to prevent deflector rotation at excessive speeds, the actual rotational speed of the deflector inherently and significantly varies as a function of changes in water pressure and flow rate through the sprinkler. Unfortunately, these parameters can vary during any given period or cycle of sprinkler operation, resulting in corresponding variations in the water stream delivery patterns for irrigating the surrounding vegetation. In addition, such fluid brake concepts require the use and effective sealed containment of a viscous fluid such as a silicon-based oil or the like, which undesirably increases the overall complexity and cost of the irrigation sprinkler.

There exists, therefore, a need for further improvements in and to rotating stream sprinklers of the type for sweeping a plurality of relatively small water streams over a surrounding terrain area, particularly with respect to maintaining the rotational speed of a vaned deflector at a controlled, relatively slow, and substantially constant rate. The present invention fulfills these needs and provides further related advantages.

SUMMARY OF THE INVENTION

In accordance with the invention, a rotating stream sprinkler is provided of the type having a rotatable vaned deflector for sweeping small streams of irrigation water in a radially outward direction to irrigate adjacent vegetation, wherein the sprinkler includes a speed control brake for maintaining a substantially constant deflector rotational speed throughout a range of normal operating pressures and flow rates. A friction plate rotatable with the deflector is urged during sprinkler operation to engage a resilient brake pad retained against a nonrotating brake disk. The brake pad includes tapered contact zones for varying the friction contact radius in response to changes in water pressure and/or flow rate to maintain deflector rotational speed substantially constant.

The rotating stream sprinkler comprises the vaned deflector having an underside surface defined by an array of spiral vanes having generally vertically oriented upstream ends which spiral or curve and merge smoothly with generally radially outwardly extending and relatively straight downstream ends. These spiral vanes cooperatively define a corresponding array of intervening, relatively small flow channels of corresponding configuration. One or more upwardly directed water jets impinges upon the spiral vanes and are subdivided into a plurality of relatively small water streams flowing through said channels. These water streams rotatably drive the deflector and are then projected generally radially outwardly therefrom. As the deflector rotates, these relatively small water streams are swept over a surrounding terrain area.

The friction plate is carried by the deflector preferably at an upper side thereof. Upon water-driven rotation, the deflector and the associated friction plate are pressed axially upwardly to move the friction plate against one side of the brake pad, an opposite side of which is seated against the nonrotating brake disk, resulting in frictional resistance to effectively retard or slow the rotational speed of the friction plate and the deflector. In the preferred form, the brake pad incorporates tapered contact zones at one and preferably both axial sides thereof for increasing the surface contact radius with the friction plate and brake disk in response to increases in water pressure and/or flow rate through the sprinkler. With this construction, the frictional resistance or torque applied by the speed control brake is varied in response to changes in water pressure and/or flow rate to maintain the rotary speed of the vaned deflector substantially constant throughout a range of normal operating pressures and flow rates. In a preferred embodiment, the brake pad is formed from a silicone rubber material, and may be surface-coated with a lubricant such as a thin layer of a selected grease or the like to provide a relatively low coefficient of static friction.

Other features and advantages of the present invention will become more apparent from the following detailed description taken in conjunction with the accompanying drawings which illustrate, by way of example, the principles of the invention.

BRIEF DESCRIPTION OF THE DRAWINGS

The accompanying drawings illustrate the invention. In such drawings:

FIG. 5 is an underside perspective view of a rotatable deflector;

FIG. 6 is an enlarged and exploded sectional view illustrating components of a speed control brake;

FIG. 7 is an enlarged sectional view of the rotating stream sprinkler depicting flow control adjustment thereof;

DETAILED DESCRIPTION OF THE PREFERRED EMBODIMENT

Figure 1:
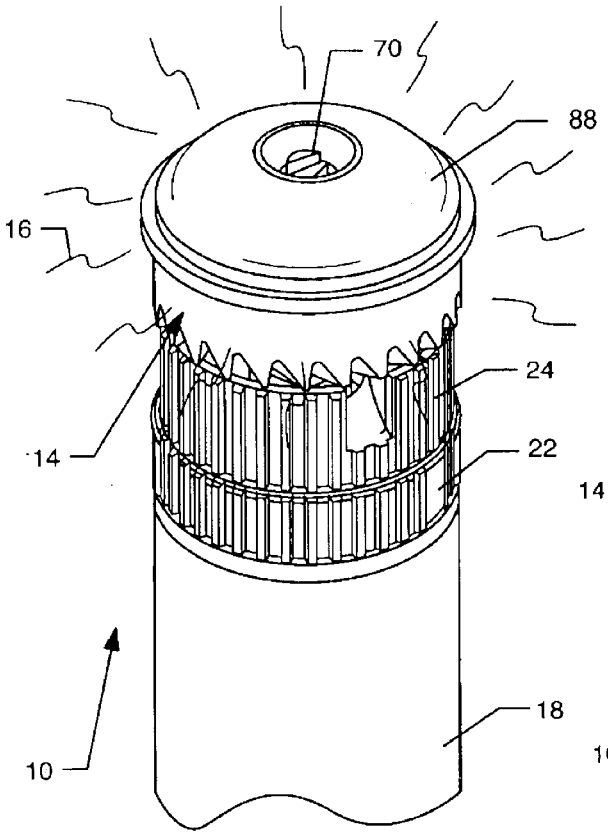
FIG. 1 is a fragmented perspective view illustrating a rotating stream sprinkler of the present invention installed onto the upper end of a riser.

As shown in the exemplary drawings, a rotating stream sprinkler referred to generally in FIG. 14 by the reference numeral 10 includes an improved speed control brake 12 (FIGS. 2–4) for controlling the rotational speed of a water-driven deflector 14 (FIGS. 2–5) which produces and distributes a plurality of relatively small water streams 16 (FIG. 1) swept over a surrounding terrain area to irrigate adjacent vegetation. The speed control brake 12 is particularly designed to maintain the rotational speed of the deflector 14 at a controlled, relatively slow, and substantially constant speed throughout a range of normal operating pressures and flow rates.

Figure 2:
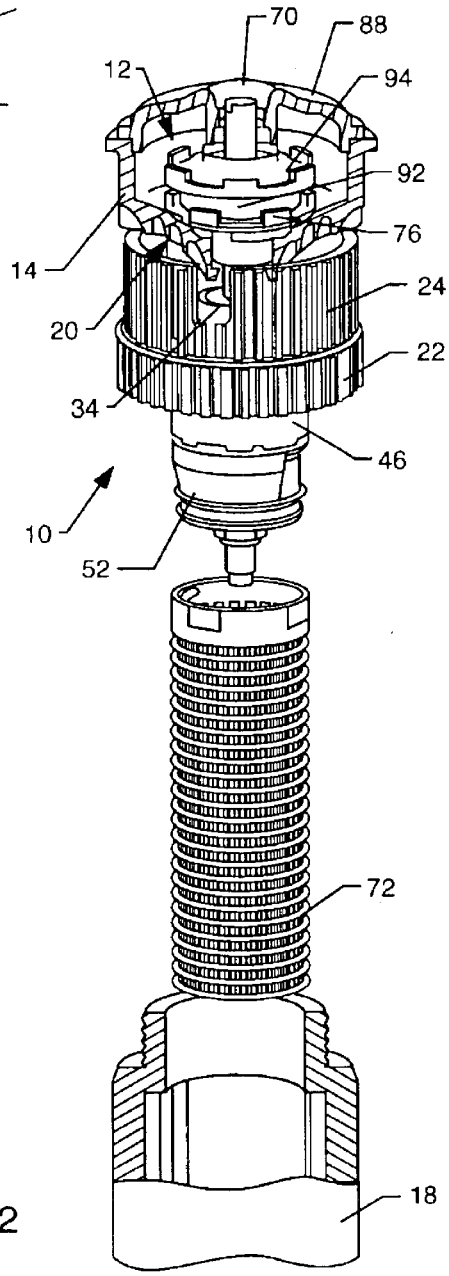
FIG. 2 is a perspective view of the rotating stream sprinkler viewed in FIG. 1, shown in exploded relation with the riser and having portions thereof depicted in partial section.

The rotating stream sprinkler 10 shown in the illustrative drawings generally comprises a compact sprinkler unit or head adapted for convenient thread-on mounting onto the upper end of a stationary or pop-up tubular riser 18 (FIGS. 1–2). In operation, water under pressure is delivered through the riser 18 to produce one or more upwardly directly water jets that impinge upon an array of spiral vanes 20 (FIG. 5) formed on an underside surface of the deflector 14 for rotatably driving the deflector. The spiral vanes 20 subdivide the water jet or jets into the plurality of relatively small water streams 16 (FIG. 1) which are thrown radially outwardly therefrom and swept over the surrounding terrain area as the deflector 14 rotates. Rotating stream sprinklers of this general type are sometimes referred to as micro-stream sprinklers, and examples thereof are shown and described in U.S. Pat. Nos. 5,288,022; 5,058,806; and 6,244,521.

The speed control brake 12 of the present invention provides a simple and effective friction mechanism for regulating and controlling rotational speed of the deflector 14 at a substantially constant rate on the order of about 4–20 rpm, notwithstanding variations in water supply pressure or flow rate, in order to maintain a consistent and uniform water pattern of water distribution during each operating cycle. This improved brake 12 utilizes mechanical braking components which do not require specialized viscous fluids or related sealed containment chambers, and the corresponding complexities and costs associated therewith. In accordance with the invention, the speed control brake 12 is substantially fully disengaged each time the sprinkler 10 is turned off, i.e., each time the pressurized water supply is turned off. When the water supply is turned on, the components of the improved brake 12 engage to produce frictional resistance that retards and thereby regulates the rotational speed of the deflector 14. In accordance with one important aspect of the invention, this frictional resistance automatically varies substantially as a linear function of fluctuations in water supply pressure or flow rate in a manner to maintain the rotational speed of the deflector 14 substantially constant throughout a range of normal operating pressures and flow rates.

Figure 3:
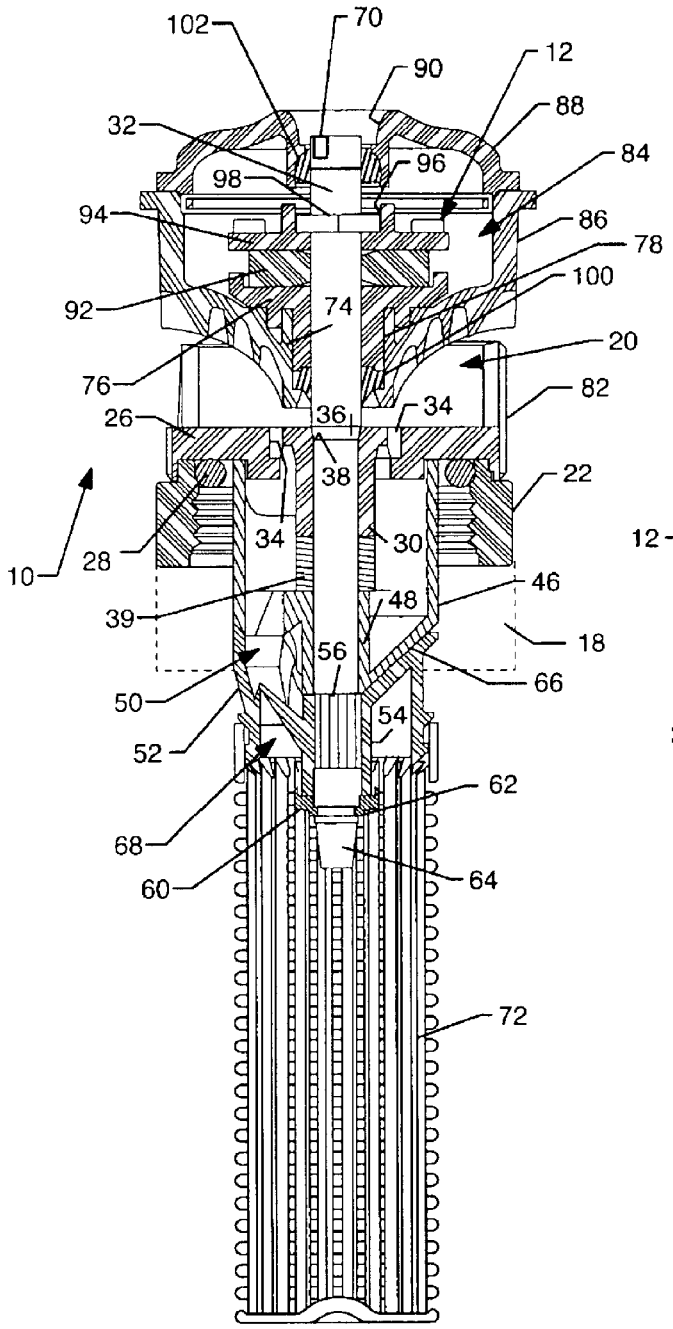
FIG. 3 is an enlarged vertical sectional view taken generally on the line 3—3 of FIG. 1.
Figure 4:
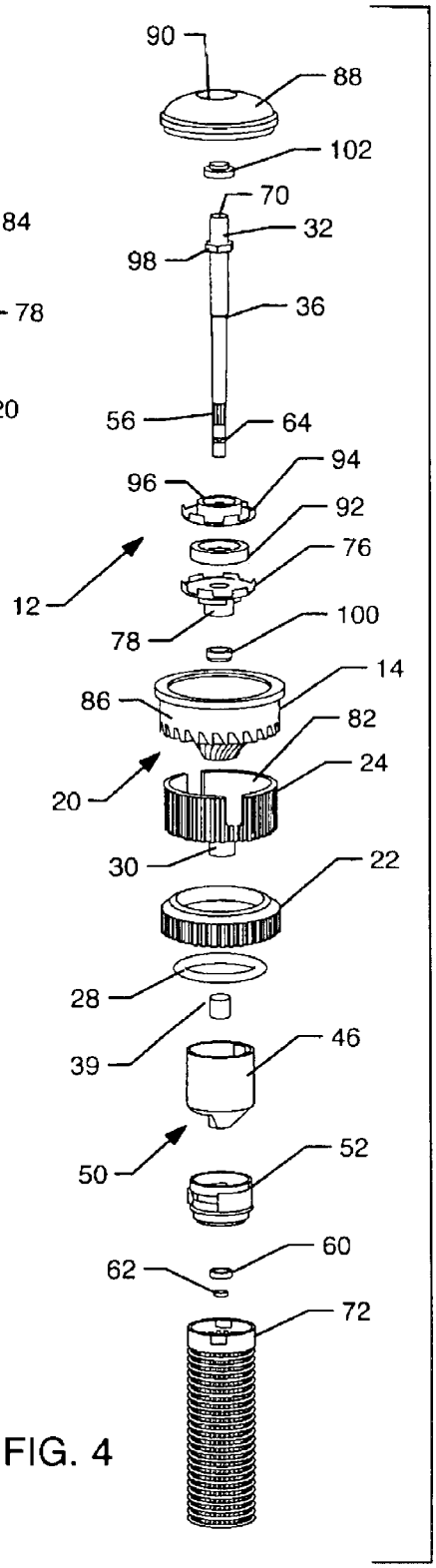
FIG. 4 is an exploded perspective view of the rotating stream sprinkler.

As shown in FIGS. 2–4, the rotating stream sprinkler 10 includes an internally threaded nozzle base 22 of generally cylindrical shape for quick and easy thread-on mounting onto a threaded upper end of the riser 18. A nozzle 24 is mounted onto an upper end of the base 22, as by ultrasonic weld connection thereto, and includes a generally circular pattern plate 26 extending across the top of the base 22 and cooperating therewith to capture and retain a seal ring 28 such as an O-ring seal for engaging an axially upper end of the riser 18 when the sprinkler 10 is mounted thereon. The pattern plate 26 includes a central hub 30 having a central post or shaft 32 extending therethrough and having the deflector 14 rotatably mounted thereon, as will be: described in more detail. One or more nozzle ports 34 are formed in an annular or part-annular array about this central hub 30 for upward passage of one or more water jets into impinging and rotatable driving engagement with the deflector 14. The number and substantially part-circle or full-circle configuration of the nozzle ports 34 are selected as is known in the art to define the predetermined spray pattern area to be irrigated by the sprinkler 10, such as a full circle, half-circle, or quarter-circle pattern.

The central post or shaft 32 has the nozzle pattern plate 26 supported thereon in a predetermined axial position. As shown best in FIG. 3, an enlarged shaft shoulder 36 is seated within a shallow counterbore 38 formed in an axially upper end of the central hub 30. A seal ring 39 is retained at an axially lower end of the hub 30.

A nozzle sleeve 46 is supported at the underside of the nozzle pattern plate 26. This nozzle sleeve 46 (FIGS. 3 and 7) has a generally cylindrical upper segment defining an annular upper end seated and retained against the underside surface of the pattern plate 26. This cylindrical upper segment extends downwardly from the pattern plate 26 and merges with a lower segment of truncated conical shape having a central hub 48 carried by the shaft 30, with an axially upper end engaging the seal ring 39.

Importantly, this truncated conical lower segment of the nozzle sleeve 46 defines an arcuate intake passage 50 for upward inflow of water under pressure from the riser 18.

A flow adjustment collar 52 is positioned at the underside of the nozzle sleeve 46 for adjustably selecting and regulating the inflow of water through the intake passage 50. As shown, the flow adjustment collar 52 has a generally cylindrical profile with a central hub 54 carried on a splined segment 56 of the shaft 32, whereby the collar 52 is rotatable with said shaft 32. The collar 52 is axially retained on the shaft 32 by a bearing washer 60 retained at an axially lower end of the collar hub 54 by a snap ring 62 or the like captured within a shallow groove 64 in the shaft. An axially upper portion of the flow adjustment collar 52 is defined by a truncated conical seat 66 positioned in substantial mating relation with the conical lower segment of the nozzle sleeve 46, and an arcuate flow port 68 is formed in this conical seat 66 for variably set alignment with the flow passage 50 in the nozzle sleeve. An upper end of the shaft 32 includes an upwardly exposed screwdriver slot 70 or the like to accommodate rotational adjustment of the arcuate flow port 68 relative to the arcuate flow passage 50, for purposes of selectively adjusting and setting the water flow rate upwardly through the nozzle sleeve 46 to the nozzle ports 34. A perforated filter 72 can be mounted as by a suitable snap-fit connection or the like onto the adjustment collar 52 to prevent entry of grit and other water-borne solid material into the sprinkler.

Figure 8:
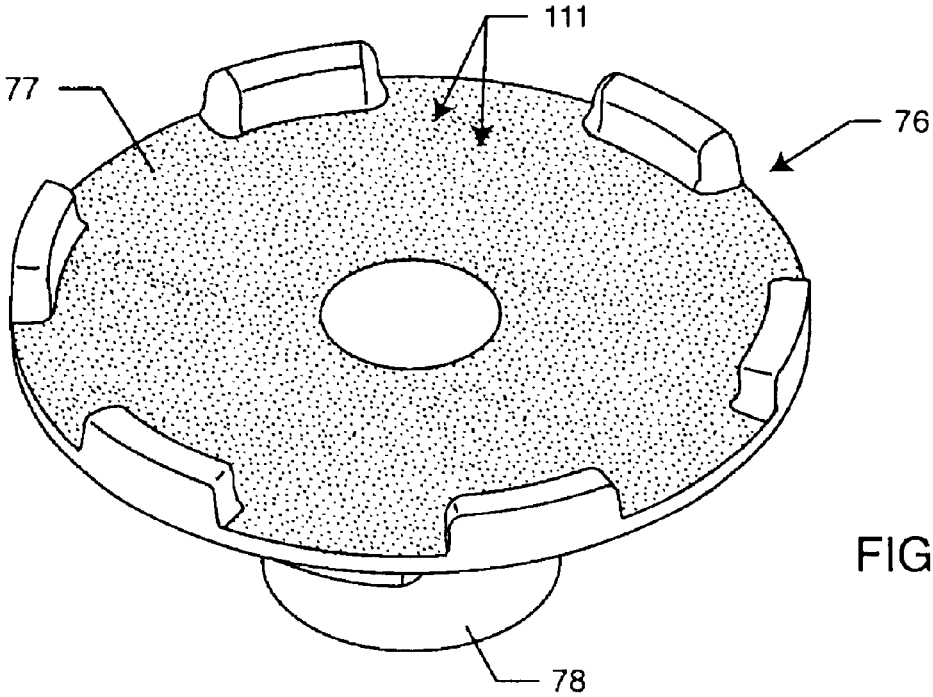
FIG. 8 is top perspective view of a lower friction plate forming a portion of the speed control brake.
Figure 9:
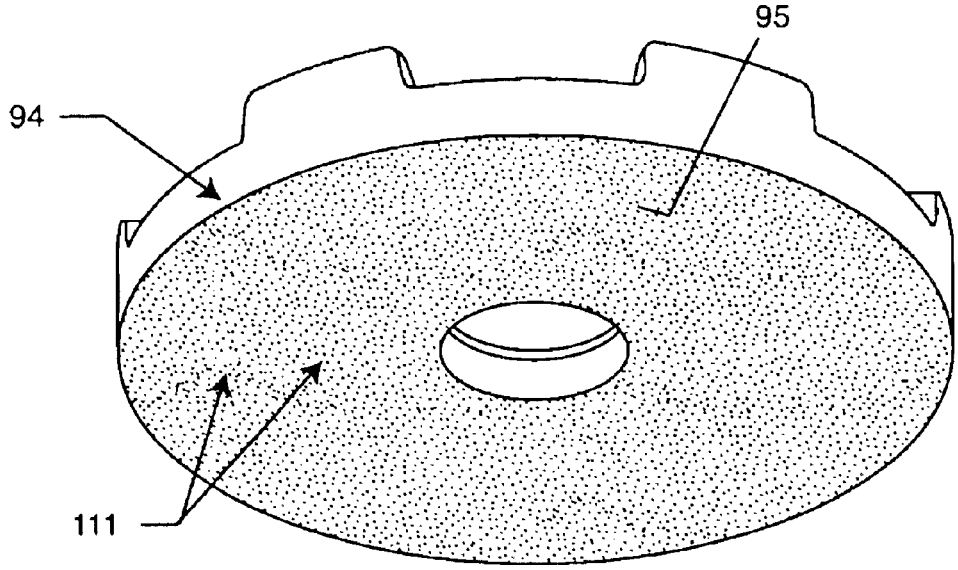
FIG. 9 is a bottom perspective view of an upper brake disk forming a portion of the speed control brake.

The deflector 14 is rotatably mounted on an upper portion of the shaft 32, at a position spaced a short distance above the pattern plate 26 of the nozzle 24. In this regard, the deflector 14 includes a central cylindrical boss 74 for slide-fit mounting onto the shaft 32. A friction plate 76 (FIGS. 34, 6 and 8), forming a portion of the brake 12 to be described in more detail, is adapted for attachment to the deflector 14 as by means of a suitable snap-fit connection or the like, and includes a central hub 78 protruding downwardly into the deflector boss 74. As viewed best in FIG. 3, the friction plate hub 78 is also slidably fitted over the shaft 32 for supporting the deflector 14 in a manner permitting relatively free rotation about the shaft 32.

The array of spiral vanes 20 is formed at the underside surface of the deflector 14, with adjacent pairs of these vanes 20 defining therebetween a corresponding plurality of relatively small flow channels 80 (FIG. 5) extending generally radially upwardly and then turning and curving generally radially outwardly with a spiral component of direction. More particularly, the vanes 20 and associated flow channels 80 include generally vertically oriented lower or upstream ends aligned generally above the nozzle ports 34 in the pattern plate 26. Water jets passing upwardly through the nozzle ports 34 are thus directed generally into the lower or upstream ends of the flow channels 80, thereby subdividing the water jets into the plurality of relatively small water streams. The upstream ends of these flow channels 80 spirally curve and merge smoothly with radially outwardly extending and relatively straight outboard channel ends, whereby the upwardly directed water flow impinges upon and rotatably drives the deflector 14. As the deflector 14 rotates, the small water streams flowing though the channels 80 are thrown radially outwardly with range of throw controlled in part by the angle of inclination of the channel outboard ends. In addition, as the deflector 14 rotates, these water streams are swept over the surrounding terrain area to be irrigated. As shown, this underside surface of the deflector 14 having the spiral vanes 20 formed thereon is spaced a short distance above an upstanding cylindrical wall 82 formed integrally on the periphery of the nozzle 24.

The components of the speed control brake 12 are mounted onto the shaft 32 within a compact and substantially sealed but unpressurized chamber 84 (FIG. 3) disposed above the deflector 14. More specifically, at the periphery of the spiral vanes 20, the deflector 14 defines a short upstanding cylindrical wall 86 having an upper margin connected as by snap-fitting or ultrasonic welding to a disk-shaped cap 88 which cooperates with the upper surface of the deflector 14 to define the chamber 84. The shaft 32 extends upwardly through the deflector 14 and the friction plate 76 as previously described into the chamber 84. An upper end of the shaft 32 is upwardly exposed through a central port 90 formed in the cap 88 to permit screwdriver access to the slotted upper end 70 thereof, to adjust the water inflow rate to the sprinkler 10, again as previously described.

A brake pad 92 (FIGS. 2–4 and 6) of generally annular shape and formed from a selected resilient friction or brake material, preferably such as silicone rubber, is positioned about the shaft 32 at the upper side of the friction plate 76. The brake pad 92 is positioned for bearing upwardly against a brake disk 94 (FIGS. 3–4, 6 and 9) carried on the shaft 32 in: a manner constrained against rotation relative to the shaft. In this regard, an upper surface of the brake disk 94 is shown to include a lock seat 96 of generally noncircular shape (FIG. 3) for seated reception of a matingly shaped lock flange 98 formed on the shaft 32, such as a hexagonal lock flange. With this construction, the brake disk 94 is prevented from rotating relative to the shaft 32. Seal members 100 and 102 may be carried about the shaft 32 generally at the lower end of the friction plate hub 78 and in a position lining the cap port 90, for substantially sealing the chamber 84 against ingress of contaminates such as dirt and grit.

In operation of the sprinkler 10, upon supply of water under pressure to the nozzle 24, one or more water jets are directed upwardly against the spiral array of vanes 20 and related flow channels 80 on the underside of the deflector 14, for rotatably driving the deflector as previously described. At the same time, the deflector 14 is shifted axially upwardly on the shaft 32 through a short stroke sufficient to carry an upper friction surface 77 (shown best in FIG. 8) on the friction plate 76 into axial face-to-face engagement with an underside contact face 104 (FIG. 6) of the brake pad 92. The brake pad 92 is also carried axially upwardly through a short stroke sufficient to move an upper brake pad contact face 106 (FIG. 6) into axial face-to-face engagement with a lower friction surface 95 (FIG. 9) on the overlying brake disk 94. With this arrangement, the resilient brake pad 92 is axially sandwiched between the rotatably driven friction plate 76 and the nonrotating brake disk 94. The brake pad 92 frictionally resists and thereby substantially slows the rotational speed of the friction plate 76 and the deflector 14 connected thereto. When the irrigation cycle is concluded, the water supply is turned off and the deflector 14 is free to descend on the shaft 32 sufficiently to disengage the brake components.

In accordance with one primary aspect of the invention, the geometry of the lower and upper annular contact faces 104 and 106 of the brake pad 92 are shaped in relation to the adjacent friction surfaces 77 and 95 of the friction plate 76 and the brake disk 94, respectively, for variably adjusting the surface contact radius therebetween in response to fluctuations in water pressure and/or flow rate which can occur in the course of any given operating cycle of the sprinkler. In this regard, the drive torque acting on the deflector 14 tends to vary generally as a linear function of increases or decreases in water pressure and flow rate. The geometry of the brake pad 92 is tailored in the illustrative preferred form of the invention to achieve substantially constant speed rotation of the friction plate 76 and deflector 14 despite such pressure and/or flow rate fluctuations within a normal operating range, by varying the friction brake torque generally as a corresponding linear function of changes in water pressure and flow rate.

More specifically, as shown best in FIG. 6 in the illustrative preferred form of the invention, the lower and upper annular faces 104 and 106 of the brake pad 92 have a tapered profile extending radially outwardly and tapering axially away from the adjacent friction contact surfaces 77 and 95 of the friction plate 76 and the brake disk 94, respectively. In one preferred configuration, in a brake pad 92 having a diametric size of about ½ inch, the tapered annular faces 104 and 106 extend axially away from the adjacent friction contact surfaces 77 and 95 of the friction plate 76 and the brake disk 94, respectively, at angles of about 2–4 degrees. With this configuration, as the resilient brake pad 92 is axially compressed in response to increased water pressure and/or increased flow rate acting upwardly on the deflector 14, the actual surface contact radius is also increased in a manner achieving a substantially linear increase in running friction torque. Conversely, as water pressure and/or flow rate decreases, the degree of brake pad compression to correspondingly decrease the actual surface contact radius between the brake pad 92 and the friction contact surfaces on the adjacent components to achieve a substantially linear decrease in brake torque.

As a result, the brake torque is appropriately increased or decreased substantially as a linear function of water pressure and/or flow rate changes to achieve substantially constant speed rotation of the deflector, preferably on the order of about 4–20 rpm for any single irrigation cycle of operation. The comparatively smaller friction contact radius at low pressure start-up conditions conveniently provides relatively minimal friction braking so that the hydraulic drive torque overcomes seal friction to initiate deflector rotation in a reliable and efficient manner. The tapered contact faces 104 and 106 on the brake pad 92 are shown to merge near the inner diameter of the annular brake pad 92 with comparatively steeper-tapered countersinks 108 and 110 which extend radially inwardly and axially away from the adjacent contact surface to effectively prevent the radius of friction contact on each side of the brake pad 92 from migrating radially inwardly as the brake pad is axially compressed during an irrigation cycle.

Although the invention is shown and described in connection with one preferred form wherein the brake pad 92 includes the tapered annular contact faces 104 and 106 on axially opposite sides thereof, persons skilled in the art will recognize and appreciate that one or both of the adjacent friction surfaces 77 and 95 of the friction plate 76 and the brake disk 94 may be tapered in lieu of the tapered contact faces on the brake pad. That is, one or both of the tapered contact faces 104 and 106 of the brake pad 92 can be omitted, with the adjacent friction surface 77 or 95 on the friction plate 76 and/or the brake disk 94 suitably tapered to extend radially outwardly and axially away from the brake pad 92. This construction will achieve the same increase or decrease in the radius of friction contact between the components, in response to increases or decreases in water pressure and flow rate.

In accordance with further aspects of the invention, the brake pad 92 and/or the adjacent friction contact surfaces 77 and 95 on the friction plate 76 and brake disk 94 may be surface-coated with a thin film of a selected lubricant, such as a suitable synthetic based lubricant or grease fortified with PTFE (polytetrafluoroethylene) or the like, to significantly reduce the static coefficient of friction between the brake components. In addition, as indicated by arrows 111 in FIGS. 8 and 9, the friction contact surfaces 77 and/or 95 formed respectively on the friction plate 76 and brake disk 94 may be textured to define an array of small valleys or other roughened surface texture for improved retention of this lubricant. Alternately, or in addition, the adjacent friction contact faces on the brake pad 92 may incorporate a similar surface texture. In such arrangement, the break-out friction or torque between the brake pad 92 and the adjacent components 76, 94 is less than the running friction or torque, to provide effective start-up operation even at relatively low hydraulic pressures. In this regard, by providing minimal friction braking at low pressure start-up operation, deflector rotation is initiated to overcome friction attributable to shaft seal components. As fluid pressure increases, the frictional resistance attributable to the speed control brake 12 increases as described to maintain a substantially constant deflector rotational speed. During such operation, in the event of water entry into the brake chamber 84, the lubricant coating the brake contact surfaces beneficially tends to repel water to insure continued and proper friction speed control.

A variety of further modifications and improvements in and to the rotating stream sprinkler of the present invention will be apparent to those persons skilled in the art. Accordingly, no limitation on the invention is intended by way of the foregoing description and accompanying drawings, except as set forth in the appended claims.

What is claimed is:

1. A rotating stream sprinkler, comprising:

a rotatable deflector defining an array of spiral vanes;

nozzle means for directing at least one water jet into driving engagement with said vanes for rotatably driving said deflector, said at least one water jet being subdivided by said vanes into a plurality of relatively small water streams distributed generally radially outwardly therefrom and swept over a surrounding terrain area by rotation of said deflector;

a speed control brake coupled to said deflector and including friction means for resisting rotation of said deflector variably in response to fluctuations in water supply pressure and flow rate to maintain deflector rotational speed substantially constant throughout a normal operating range of water pressures and flow rates; and said friction means including a first friction member mounted for rotation with said deflector and a second friction member nonrotatably mounted to said sprinkler and engageable by said first function member, said first and second friction members being moveable axially relative to each other in response to said fluctuations in water supply pressure and flow rate.

2. The rotating stream sprinkler of claim 1 wherein said speed control brake comprises a friction plate carried by said deflector for rotation therewith, a nonrotational brake disk, and a resilient brake pad interposed between said friction plate and said brake disk.

3. The rotating stream sprinkler of claim 2 wherein said brake pad is formed from a silicone rubber.

4. The rotating stream sprinkler of claim 2 wherein said brake pad includes axially opposed contact faces for friction bearing engagement respectively with friction surfaces on said friction plate and said brake disk.

5. The rotating stream sprinkler of claim 4 wherein said brake pad contact faces are coated with a lubricant.

6. The rotating stream sprinkler of claim 5 wherein said brake pad contact faces are textured.

7. The rotating stream sprinkler of claim 5 wherein at least one of said brake pad contact faces and said friction surfaces on said friction plate and said brake disk is textured.

8. The rotating stream sprinkler of claim 4 wherein said friction plate is urged upon increased water pressure in an axial direction compressing said brake pad against said brake disk, and further wherein at least one of said brake pad contact faces and said friction surfaces on said fiction plate and said brake disk is tapered for increased friction radius engagement between said brake disk and at least one of said friction plate and said brake disk upon such in increased water pressure.

9. The rotating stream sprinkler of claim 2 further including a shaft having said deflector rotatably carried thereon, said brake disk being mounted on an constrained against rotation relative to said shaft, said brake pad comprising a generally annular disk carried on said shaft and defining a pair of axially opposed and generally annular faces for friction bearing engagement respectively with said friction surfaces on said friction plate and said brake disk.

10. The rotating stream sprinkler of claim 9 wherein said friction plate is urged upon increased water pressure in an axial direction compressing said brake pad against said brake disk, and further wherein said brake pad contact faces are tapered to extend radially outwardly and axially away from said friction plate and said brake disk, respectively, for increased friction radius engagement therewith upon such increased water pressure.

11. The rotating stream sprinkler of claim 1 further including means defining a substantially closed chamber having said speed control brake mounted therein.

12. A rotating stream sprinkler, comprising:

a rotatable deflector defining an array of spiral vanes;

nozzle means for directing at least one water jet into driving engagement with said vanes for rotatably driving said deflector, said at least one water jet being subdivided by said vanes into a plurality of relatively small water streams distributed generally radially outwardly therefrom and swept over a surrounding terrain area by rotation of said deflector; and a speed control brake coupled to said deflector and including friction means for resisting rotation of said deflector variably in response to fluctuations in water supply pressure and flow rate to maintain deflector rotational speed substantially constant throughout a normal operating range of water pressures and flow rates;

said speed control brake including a friction plate carried by said deflector for rotation therewith, a nonrotational brake disk, and a brake pad interposed between friction surfaces on said friction plate and said brake disk, said brake pad includes axially opposed contact faces for friction bearing engagement respectively with said friction plate and said brake disk;

said deflector and said friction plate being axially movable in response to increased water pressure acting on said deflector for compressing said brake pad against said brake disk, and further wherein at least one of said brake pad contact faces and said friction surfaces on said friction plate and said brake disk is tapered for increased friction radius engagement of said brake pad with at least one of said friction plate and said brake disk upon such increased water pressure.

13. The rotating stream sprinkler of claim 12 wherein said brake pad is formed from a resilient material.

14. A rotating stream sprinkler, comprising:

a nozzle base defining at least one nozzle port formed therein and oriented for discharging at least one generally upwardly directed water jet upon connection of the sprinkler to a supply of water under pressure;

a generally vertically extending shaft supported by said nozzle base;

a deflector rotatably mounted on said shaft and having an underside surface defining an array of spiral vanes forming intervening spiral channels having upwardly extending upstream ends disposed in closely spaced relation above said at least one nozzle port, said upstream ends spirally curving and merging smoothly with downstream channel ends extending generally radially outwardly, whereby said deflector is rotatably driven by said at least one water jet impinging upon said spiral vanes and further whereby said at least one water jet is subdivided into a plurality of relatively small water streams flowing through said spiral channels for distribution generally radially outwardly therefrom and rotatably swept over a surrounding terrain area upon rotation of said deflector; and a speed control brake coupled to said deflector and including friction means for resisting rotation of said deflector variably in response to fluctuations in water supply pressure and flow to maintain deflector rotational speed substantially constant throughout a normal operating range of water pressures and flow rates;

said speed control brake including a friction plate rotatable with said deflector and disposed at an upper side thereof, a brake disk mounted on and constrained against rotation relative to said shaft, and a generally annular brake pad carried on said shaft in a position interposed axially between said friction plate and said brake disk, said brake pad including axially opposed contact faces for frictionally engaging friction surfaces formed respectively on said friction plate and said brake disk;

said deflector and said friction plate being axially movable in response to increased water pressure and flow rate acting on said deflector for compressing said brake pad against said brake disk, and further wherein at least one of said brake pad contact faces and said friction surfaces on said friction plate and said brake disk is tapered for increased friction radius engagement between said brake pad and at least one of said friction plate and said brake disk upon such increased water pressure and flow rate.

15. The rotating stream sprinkler of claim 14 wherein said brake pad is formed from a resilient material.

16. The rotating stream sprinkler of claim 15 wherein at least one of said brake pad contact faces is coated with a lubricant.

17. The rotating stream sprinkler of claim 16 wherein at least one of said brake pad contact faces and said friction surfaces on said friction plate and said brake disk is textured.

18. The rotating stream sprinkler of claim 14 wherein said brake pad contact faces being tapered to extend radially outwardly and axially away from said friction plate and said brake disk, respectively for increased friction radius engagement therewith upon increased water pressure and flow rate.

19. The rotating stream sprinkler of claim 14 wherein said tapered annular contact faces have inner diameter margins, and further including comparatively steeper-tapered countersinks formed in said brake pad and extending radially inwardly from said inner diameter margins of said contact faces.

20. The rotating stream sprinkler of claim 14 further including cap means cooperating with said deflector for defining a substantially closed brake chamber having said speed control brake mounted therein.

21. The rotating stream sprinkler of claim 20 further including seal means for substantially sealing said brake chamber against particular ingress.

22. The rotating stream sprinkler of claim 14 further including water inlet means including a water inlet passage disposed upstream relative to said at least one nozzle port, a flow adjustment collar carried by said shaft and including a flow port for variably overlying said inlet passage upon rotation of said shaft to correspondingly and selectively vary water flow rate to said at least one nozzle port, said shaft having an upper end exposed through said cap means for variably setting the rotational position of said shaft to select the water flow rate.

23. The rotating stream sprinkler of claim 22 wherein said exposed upper end of said shaft is slotted.

24. The rotating stream sprinkler of claim 14 further including means for mounting said nozzle base onto a sprinkler riser.

25. In a rotating stream sprinkler having a rotatable deflector defining an array of spiral vanes, and nozzle means for directing at least one water jet into driving engagement with said vanes for rotatably driving said deflector and for subdividing said at least one water jet into a plurality of relatively small water streams swept over a surrounding terrain area, the improvement comprising:

a speed control brake coupled to said deflector and including friction means for variably resisting rotation of said deflector to maintain deflector rotational speed substantially constant throughout a range of normal water supply pressures and flow rates;

said friction means including a first friction member mounted for rotation with said deflector and a second friction member nonrotatably mounted to said sprinkler and engageable by said first friction member, said first and second friction members being moveable axially relative to each other.

26. The improvement of claim 25 wherein said speed control brake comprises a friction plate rotatable with said deflector and disposed at an upper side thereof, a brake disk mounted on and constrained against rotation relative to said friction plate, and a brake pad interpose axially between said friction plate and said brake disk, said brake pad including axially opposed contact faces for frictional engagement with friction surfaces formed respectively on said friction plate and said brake disk, said deflector and said friction plate being axially movable in response to increased water pressure and flow rate acting on said deflector for compressing said brake pad against said brake disk, and further wherein at least one of said brake pad contact faces and said friction surfaces on said friction plate and said brake disk is tapered for increased friction radius engagement between said brake pad and at least one of said friction plate and said brake disk upon such increased water pressure and flow rate.

* * * * *